US010906565B2

(12) United States Patent
Taga et al.

(10) Patent No.: US 10,906,565 B2
(45) Date of Patent: Feb. 2, 2021

(54) AXLE BOX SUSPENSION OF RAILCAR BOGIE AND METHOD OF PRODUCING THE SAME

(71) Applicant: KAWASAKI JUKOGYO KABUSHIKI KAISHA, Kobe (JP)

(72) Inventors: Yukitaka Taga, Kobe (JP); Fumikazu Kounoike, Kakogawa (JP); Yukihiro Sano, Kobe (JP); Takaya Ono, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 254 days.

(21) Appl. No.: 16/065,887

(22) PCT Filed: Nov. 29, 2016

(86) PCT No.: PCT/JP2016/005006
§ 371 (c)(1),
(2) Date: Jun. 25, 2018

(87) PCT Pub. No.: WO2017/110046
PCT Pub. Date: Jun. 29, 2017

(65) Prior Publication Data

US 2019/0009798 A1 Jan. 10, 2019

(30) Foreign Application Priority Data

Dec. 25, 2015 (JP) ..... 2015-252983

(51) Int. Cl.
*B61F 5/30* (2006.01)
*B61F 5/32* (2006.01)
(Continued)

(52) U.S. Cl.
CPC ..... *B61F 5/30* (2013.01); *B61F 5/32* (2013.01); *B61F 3/02* (2013.01); *B61F 15/02* (2013.01)

(58) Field of Classification Search
CPC .... B61F 5/302; B61F 5/32; B61F 5/46; B61F 5/52; B61F 3/02; B61F 5/305;
(Continued)

(56) References Cited

U.S. PATENT DOCUMENTS 2,560,413 A * 7/1951 Carlson ..... F16B 19/02 384/434
8,297,199 B2 * 10/2012 Nishimura ..... F16F 1/38 105/218.1
(Continued)

FOREIGN PATENT DOCUMENTS

CN 201193037 Y 2/2009
JP S64-078737 A 3/1989
(Continued)

*Primary Examiner* — Mark T Le
(74) *Attorney, Agent, or Firm* — Oliff PLC

(57) ABSTRACT

A railcar bogie axle box suspension axle beam includes an end portion d at a tip end, a tubular portion at the end portion and being open at both car width direction sides. The tubular portion includes: a first semi-tubular portion integrally formed with a main body portion; a second semi-tubular portion brought into contact with the first semi-tubular portion from one side in the car longitudinal direction; and a bolt fastening the second semi-tubular portion to the first. The first semi-tubular portion includes: a flat opposing surface contacting the second semi-tubular portion; and a hole into which the bolt is inserted. The second semi-tubular portion includes: a flat opposing surface contacting with the first semi-tubular portion surface; a flat machining reference surface formed at an opposite side of the opposing surface;
(Continued)

and a hole extending in a direction perpendicular to the opposing surface, the bolt inserted into the hole.

5 Claims, 7 Drawing Sheets

(51) Int. Cl.
*B61F 3/02* (2006.01)
*B61F 15/02* (2006.01)

(58) Field of Classification Search
CPC .... B61F 5/325; B61F 5/36; B61F 5/50; B61F 5/30; F16C 11/02; F16C 11/04; F16C 9/02; F16C 9/04; B23Q 3/00; B23Q 3/183; B23Q 3/186; F16B 7/00; F16B 7/04; F16B 7/0406; F16B 7/18
USPC ..... 105/206.1, 206.2, 218.2
See application file for complete search history.

(56) References Cited

U.S. PATENT DOCUMENTS

| | | | |
|---|---|---|---|
| 2011/0253004 | A1 | 10/2011 | Nishimura et al. |
| 2015/0344046 | A1 | 12/2015 | Nishimura et al. |
| 2016/0304102 | A1 | 10/2016 | Okumura et al. |

FOREIGN PATENT DOCUMENTS

| | | | |
|---|---|---|---|
| JP | 2002-211395 | A | 7/2002 |
| JP | 2006-298172 | A | 11/2006 |
| JP | 2010-184684 | A | 8/2010 |
| JP | 2015-107773 | A | 6/2015 |
| WO | 2014/109279 | A1 | 7/2014 |

* cited by examiner

AXLE BOX SUSPENSION OF RAILCAR BOGIE AND METHOD OF PRODUCING THE SAME

TECHNICAL FIELD

The present invention relates to an axle box suspension of a railcar bogie and a method of producing the axle box suspension.

BACKGROUND ART

In a railcar bogie, an axle box accommodating a bearing rotatably supporting an axle is supported by a bogie frame through an axle box suspension. For example, PTL 1 discloses a bogie including an axle beam type axle box suspension, and an axle box is supported by a side sill of a bogie frame through an axle beam formed integrally with the axle box and extending in a car longitudinal direction.

In PTL 1, a cylindrical portion that is open at both car width direction sides is formed at one car longitudinal direction end of the axle beam connected to the side sill. A core rod is inserted into the cylindrical portion through a rubber bushing. Both end portions of the core rod which portions project from both respective car width direction sides of the cylindrical portion fit respective groove portions of receiving seats provided at the bogie frame. To insert the rubber bushing and the core rod into the cylindrical portion of the axle beam, the cylindrical portion is divided in the car longitudinal direction at a boundary that is a dividing line extending in an upward/downward direction. The cylindrical portion is constituted by: a first semi-tubular portion formed integrally with the axle beam; and a second semi-tubular portion fastened to the first semi-tubular portion by a bolt and a nut.

To realize fastening of the second semi-tubular portion to the first semi-tubular portion formed integrally with the axle beam, the second semi-tubular portion needs to be subjected to machining. Specifically, in addition to a step of performing flattening of enhancing flatness of a contact surface of the second semi-tubular portion which surface contacts the first semi-tubular portion, required are steps of: forming a through hole into which a bolt is inserted; and performing work of enhancing flatness of a seat surface contacting a head portion of the bolt.

CITATION LIST

Patent Literature

PTL 1: Japanese Laid-Open Patent Application Publication No. 2015-107773

SUMMARY OF INVENTION

Technical Problem

In the step of forming the through hole into which the bolt is inserted, the through hole needs to be formed with a high degree of accuracy, and therefore, the second semi-tubular portion needs to be stably placed at a machining device. An outer shape of the second semi-tubular portion is a semicircular shape. Therefore, to stably place the contact surface, which contacts the flat first semi-tubular portion, on a surface plate of the machining device, in a step immediately before the step of forming the through hole, the contact surface needs to be set to face upward with a high degree of accuracy, be held with a jig or the like, and be machined, and then, set-up change work of reversing the second semi-tubular portion is also necessary.

An object of the present invention is to reduce work man-hours of machining required for a second semi-tubular portion fastened to a first semi-tubular portion formed integrally with an axle beam in an axle box suspension of a railcar bogie.

Solution to Problem

An axle box suspension of a railcar bogie according to one aspect of the present invention includes: an axle beam including an axle beam main body portion extending in a car longitudinal direction from an axle box accommodating a bearing supporting an axle and an axle beam end portion provided at a tip end of the axle beam main body portion, a tubular portion being formed at the axle beam end portion and being open at both car width direction sides; a core rod inserted into an internal space of the tubular portion in a car width direction; an elastic bushing interposed between the tubular portion and the core rod; and a receiving seat provided at a bogie frame, both end portions of the core rod being connected to the receiving seat, the tubular portion including a first semi-tubular portion formed integrally with the axle beam main body portion, a second semi-tubular portion which is brought into contact with the first semi-tubular portion from one side in the car longitudinal direction, and a bolt by which the second semi-tubular portion is fastened to the first semi-tubular portion in the car longitudinal direction, the first semi-tubular portion including a flat opposing surface that is in surface contact with the second semi-tubular portion and a hole extending in a direction perpendicular to the opposing surface, the bolt being inserted into the hole, the second semi-tubular portion including a flat opposing surface that is in surface contact with the opposing surface of the first semi-tubular portion, a flat machining reference surface formed at an opposite side of the opposing surface, and a hole extending in a direction perpendicular to the opposing surface, the bolt being inserted into the hole.

According to the above configuration, since the second semi-tubular portion includes the machining reference surface, the second semi-tubular portion can be stably placed on the surface plate of the machining device, and a step of machining the opposing surface and a step of forming the hole can be performed with a high degree of accuracy. When performing these two steps, set-up change work of reversing the posture of the second semi-tubular portion is unnecessary. Therefore, the working property improves.

A method of producing an axle box suspension of a railcar bogie according to one aspect of the present invention is a method of producing an axle box suspension, the axle box suspension including an axle beam, the axle beam including an axle beam main body portion extending in a car longitudinal direction from an axle box accommodating a bearing supporting an axle and an axle beam end portion provided at a tip end of the axle beam main body portion, a tubular portion being formed at the axle beam end portion and being open at both car width direction sides, the tubular portion including a first semi-tubular portion formed integrally with the axle beam main body portion, a second semi-tubular portion which is brought into contact with the first semi-tubular portion, and a bolt by which the second semi-tubular portion is fastened to the first semi-tubular portion, the method including: an opposing surface machining step of providing the second semi-tubular portion at a machining device such that a flat machining reference surface of the second semi-tubular portion contacts a surface plate of the machining device, and flattening a flat opposing surface of the second semi-tubular portion, the opposing surface being formed to be in surface contact with the first semi-tubular portion, the machining reference surface being formed at an opposite side of the opposing surface; and a hole forming step of forming a hole at the second semi-tubular portion which is in a same installation posture as in the opposing surface machining step, the bolt being inserted into the hole.

According to the above method, since the second semi-tubular portion includes the machining reference surface, the second semi-tubular portion can be stably placed on the surface plate of the machining device, and the opposing surface machining step and the hole forming step can be performed with a high degree of accuracy. When performing these two steps, set-up change work of reversing the posture of the second semi-tubular portion is unnecessary. Therefore, the working property improves. Further, since an inner peripheral surface of the tubular portion is subjected to complete circle machining with the second semi-tubular portion contacting the first semi-tubular portion, the elastic bushing inserted into the tubular portion can be satisfactorily tightened by the inner peripheral surface of the tubular portion subjected to the complete circle machining.

Advantageous Effects of Invention

The present invention can reduce work man-hours of machining required for the second semi-tubular portion fastened to the first semi-tubular portion formed integrally with the axle beam in the axle box suspension of the railcar bogie.

DESCRIPTION OF EMBODIMENTS

Figure 1:
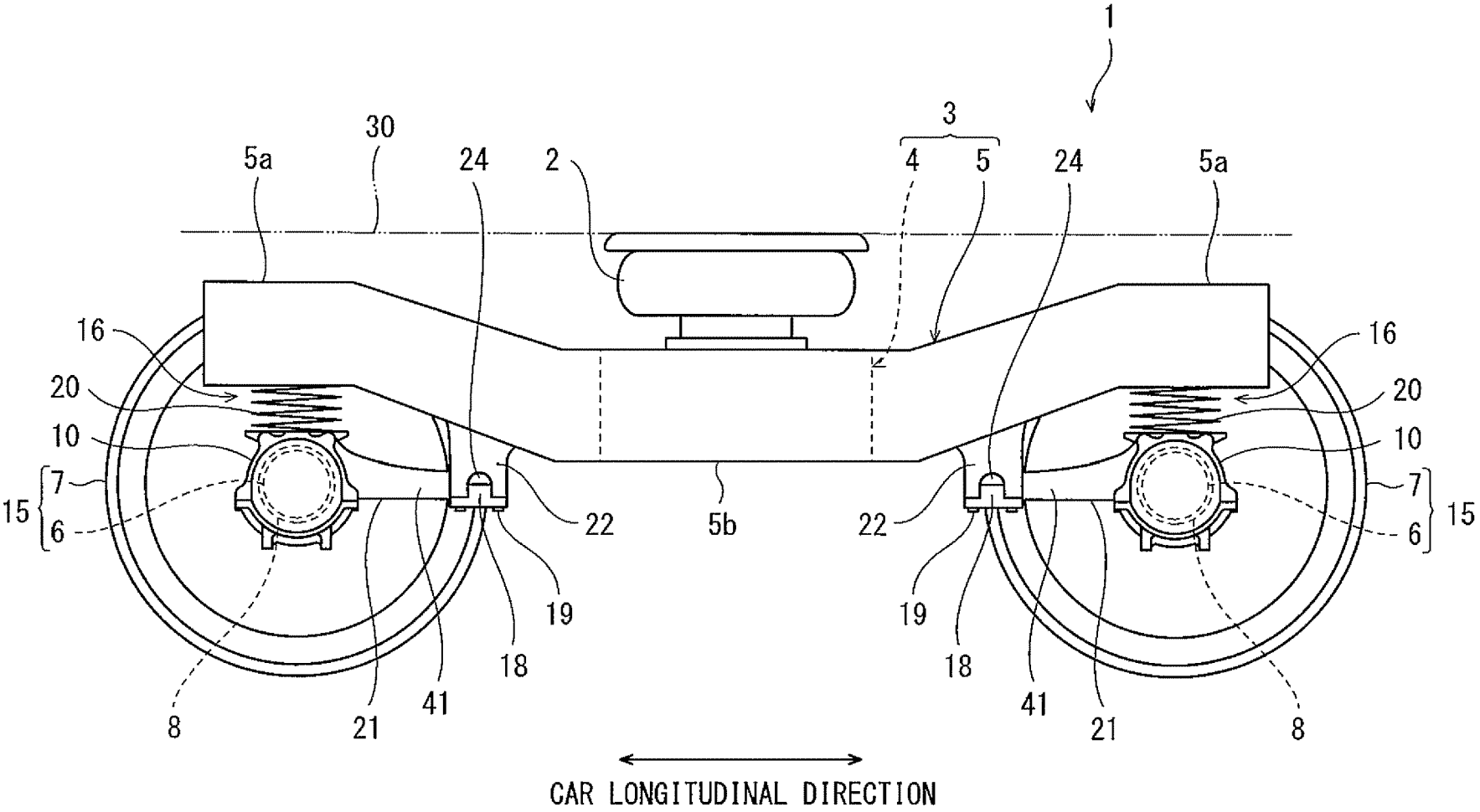
FIG. 1 is a side view of a railcar bogie according to Embodiment 1.

Hereinafter, embodiments will be explained with reference to the drawings. In the drawings, the same reference signs are used for the same or corresponding components, and a repetition of the same explanation is avoided.

Embodiment 1

FIG. 1 is a side view of a railcar bogie 1 according to Embodiment 1. As shown in FIG. 1, the railcar bogie (hereinafter referred to as a "bogie") 1 includes a bogie frame 3 connected to a carbody 30 through an air spring 2. The bogie frame 3 includes: a cross beam 4 extending in a car width direction at a car longitudinal direction middle of the bogie 1; and side sills 5 extending in a car longitudinal direction from both respective car width direction end portions of the cross beam 4.

Axles 6 each extending in the car width direction are arranged at both respective car longitudinal direction sides of the bogie frame 3. Wheels 7 are press-fitted to both respective car width direction sides of each of the axles 6. The axle 6 and the wheels 7 constitute a wheelset 15. A pair of wheelsets 15 provided at the bogie 1 are arranged at both respective car longitudinal direction sides of the bogie frame 3 so as to be spaced apart from each other. Bearings 8 rotatably supporting the wheels 7 are provided at both respective car width direction end portions of each axle 6 so as to be located outside the wheels 7 in the car width direction. The bearings 8 are accommodated in respective axle boxes 10.

Each of the axle boxes 10 is elastically coupled to the bogie frame 3 through a corresponding axle box suspension 16. The axle box suspension 16 includes an axle spring 20 and an axle beam 21. The axle spring 20 connects the axle box 10 and a car longitudinal direction end portion 5*a* of the side sill 5 in an upward/downward direction. The axle beam 21 couples the axle box 10 and the side sill 5 in the car longitudinal direction. The axle beam 21 is formed integrally with the axle box 10 and extends in the car longitudinal direction. A tubular portion 25 (see FIG. 2) that is open at both car width direction sides is formed at a tip end of the axle beam 21. A core rod 24 is inserted into an internal space S of the tubular portion 25 through an elastic bushing 23 (see FIG. 4).

A pair of receiving seats 22 are provided at the side sill 5 and are coupled to the axle beam 21 through the elastic bushing 23 and the core rod 24. Specifically, the receiving seats 22 are provided so as to project downward from a lower surface 5*b* of the side sill 5, and the core rod 24 is fitted to groove portions 22*a* (see FIG. 4) formed at the respective receiving seats 22. In this state, a lid member 18 is fixed to the receiving seats 22 by bolts 19 so as to close lower openings of the groove portions 22*a*. With this, the core rod 24 is sandwiched by the receiving seats 22 and the lid member 18. Thus, the core rod 24 is connected to the receiving seats 22.

Figure 2:
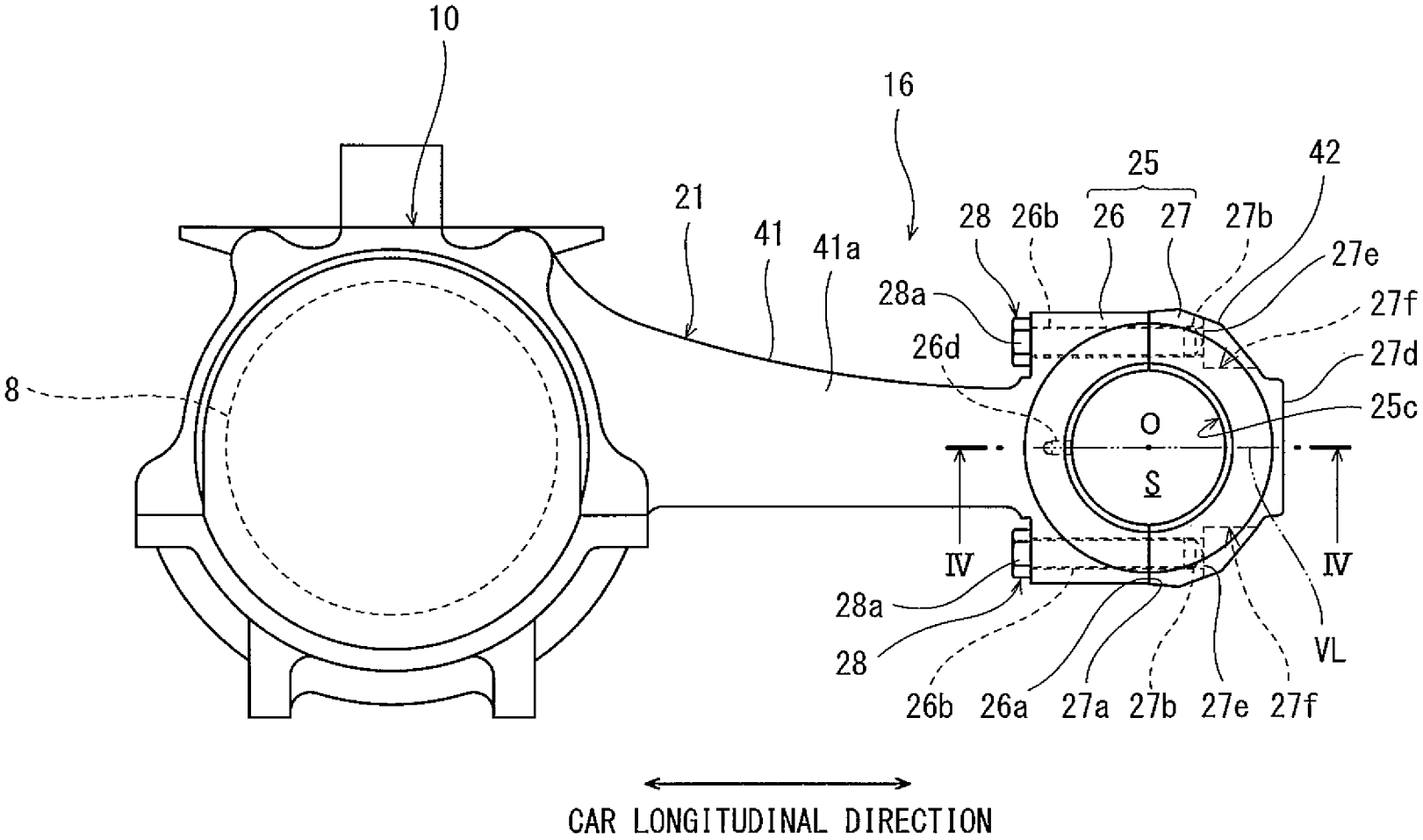
FIG. 2 is an enlarged side view showing a vicinity of an axle beam of an axle box suspension shown in FIG. 1.
Figure 3:
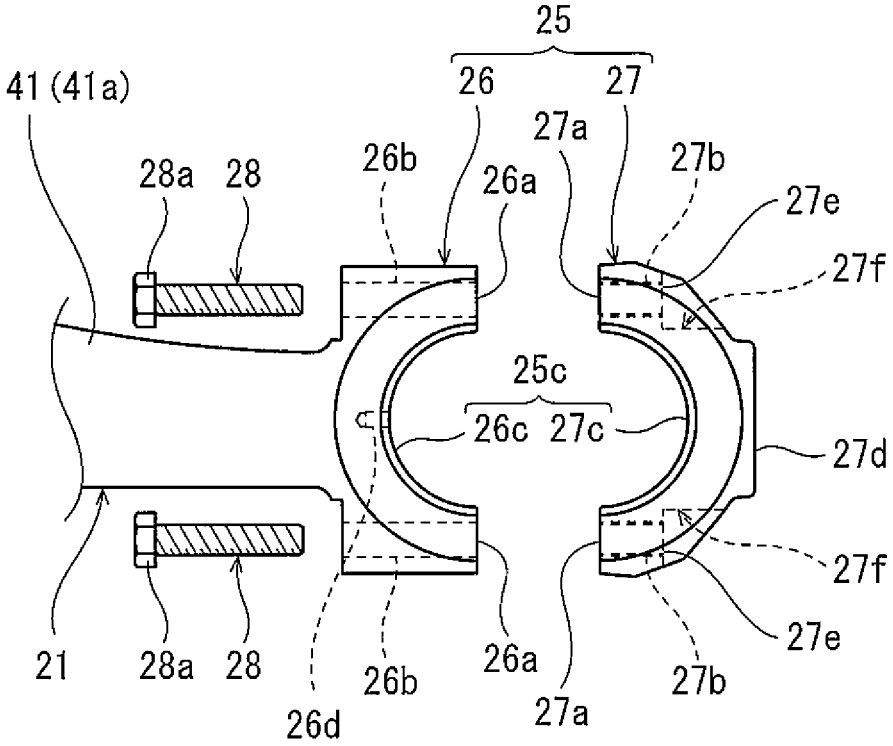
FIG. 3 is an exploded side view of a tubular portion of the axle beam shown in FIG. 2.

FIG. 2 is an enlarged side view showing a vicinity of the axle beam 21 of the axle box suspension 16 shown in FIG. 1. FIG. 3 is an exploded side view of the tubular portion 25 of the axle beam 21 shown in FIG. 2. In FIGS. 2 and 3, for convenience of explanation, the axle spring 20, the rubber bushing 23, the core rod 24, the receiving seats 22, and the lid member 18 are not shown. As shown in FIGS. 2 and 3, the axle beam 21 includes an axle beam main body portion 41 and an axle beam end portion 42 at which the tubular portion 25 is formed. The axle beam main body portion 41 includes: a pair of side plate portions 41*a* extending in the car longitudinal direction; and a coupling plate portion 41*b* (see FIG. 4) coupling the pair of side plate portions 41*a* in the car width direction. With this, a sectional shape of the axle beam main body portion 41 is a substantially H shape when viewed from the car longitudinal direction.

The tubular portion 25 of the axle beam end portion 42 is divided into a first semi-tubular portion 26 and a second semi-tubular portion 27. The first semi-tubular portion 26 is formed integrally with the axle beam main body portion 41. The second semi-tubular portion 27 is brought into contact with the first semi-tubular portion 26 from an outer side in the car longitudinal direction. The second semi-tubular portion 27 is fixed to the first semi-tubular portion 26 by a plurality of bolts 28. With this configuration, the internal space S into which the rubber bushing 23 and the core rod 24 are inserted and which has a completely circular column shape is formed.

The bolts 28 are inserted from the first semi-tubular portion 26 side toward the second semi-tubular portion 27. To prevent the bolts 28 from interfering with the side plate portions 41*a* of the axle beam main body portion 41 when inserting the bolts 28 from the first semi-tubular portion 26, each of upper edges of the side plate portions 41*a* is formed in a smoothly curved shape (arc shape) in a side view. Specifically, at least a half, located close to the first semi-tubular portion 26, of the upper edge of the side plate portion 41*a* is formed so as not to overlap an axis of the upper bolt 28 in the upward/downward direction. Further, each of lower edges of the side plate portions 41*a* extends from the axle box 10 in parallel with a horizontal line so as not to overlap an axis of the lower bolt 28 in the upward/downward direction.

Each of the first semi-tubular portion 26 and the second semi-tubular portion 27 is produced by: molding a metal material (for example, carbon steel) by casting or forging; and then subjecting the obtained metal material to machining. The first semi-tubular portion 26 includes a flat opposing surface 26*a* and holes 26*b* extending in a direction (car longitudinal direction) perpendicular to the opposing surface 26*a*. The opposing surface 26*a* is in surface contact with an opposing surface 27*a* of the second semi-tubular portion 27. The bolts 28 are inserted into the respective holes 26*b*. The holes 26*b* are drilled holes and penetrate the first semi-tubular portion 26 in the car longitudinal direction.

The second semi-tubular portion 27 includes: the flat opposing surface 27*a*; holes 27*b* extending in a direction (car longitudinal direction) perpendicular to the opposing surface 27*a*; and a flat machining reference surface 27*d* formed at an opposite side of the opposing surface 27*a*. In addition, the second semi-tubular portion 27 further includes intermediate surfaces 27*e* located between the opposing surface 27*a* and the machining reference surface 27*d*. The opposing surface 27*a* is in surface contact with the opposing surface 26*a* of the first semi-tubular portion 26. The bolts 28 are inserted into the respective holes 27*b*. The holes 27*b* are threaded holes each including an inner peripheral surface on which an internal thread is formed. The first semi-tubular portion 26 and the second semi-tubular portion 27 are fixed to each other by the bolts 28.

Each of the intermediate surfaces 27*e* is a surface constituting a recessed portion 27*f* formed by recessing an outer surface of the second semi-tubular portion 27 toward the opposing surface 27*a*. Specifically, when viewed from the car longitudinal direction, the intermediate surface 27*e* overlaps the opposing surface 27*a*. The threaded hole 27*b* penetrates the second semi-tubular portion 27 from the opposing surface 27*a* to the intermediate surface 27*e*. A tip end portion of each bolt 28 inserted into the threaded hole 27*b* is located immediately before the intermediate surface 27*e*. It should be noted that the tip end portion of the bolt 28 may be flush with the intermediate surface 27*e* or may project from the intermediate surface 27*e*.

The intermediate surface 27*e* is formed from the viewpoint of sharing of parts with conventional structures and weight reduction.

As described below, in a conventional tubular portion 125, bolts 128 are inserted from a second semi-tubular portion 127 side toward a first semi-tubular portion 126 (see FIG. 6E). The conventional second semi-tubular portion 127 includes seat surfaces with which respective head portions of the bolts 128 are in contact. The seat surfaces correspond to the intermediate surfaces 27*e* of the present embodiment. Therefore, although an insertion direction of the bolt 28 into the tubular portion 25 of the present embodiment is opposite to an insertion direction of the bolt into the conventional tubular portion 125, the bolt can be inserted into the tubular portion 25 of the present embodiment in the same direction as the conventional tubular portion 125 by the formation of the intermediate surface 27*e*. The intermediate surfaces 27*e* and the recessed portions 27*f* are formed also for the weight reduction of the second semi-tubular portion 27. It should be noted that the intermediate surfaces 27*e* and the recessed portions 27*f* do not have to be formed at the tubular portion 25 of the present embodiment.

Figure 4:
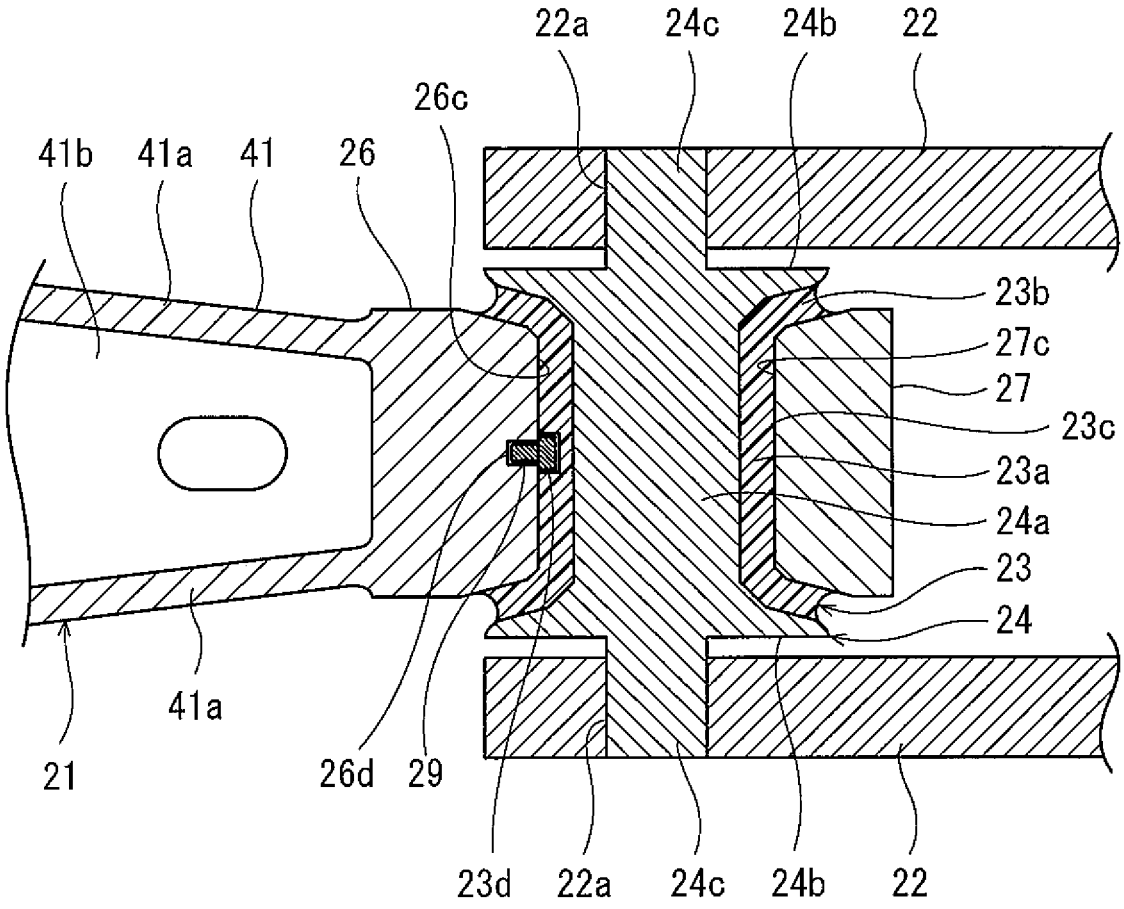
FIG. 4 is a sectional view taken along line IV-IV of FIG. 2.

FIG. 4 is a sectional view taken along line IV-IV of FIG. 2. As described above, the core rod 24 couples the axle beam 21 and the side sill 5, and as shown in FIG. 4, is inserted into the tubular portion 25 in the car width direction. The core rod 24 includes a columnar portion 24*a*, a pair of conical flange portions 24*b*, and projecting end portions 24*c*. The elastic bushing 23 is interposed between the tubular portion 25 and the core rod 24. In the present embodiment, the elastic bushing 23 is a rubber bushing.

The rubber bushing 23 includes a cylindrical portion 23*a* and a pair of flange portions 23*b* projecting outward in a radial direction. The rubber bushing 23 is externally fitted to the core rod 24. When the rubber bushing 23 is inserted into the tubular portion 25, the rubber bushing 23 is tightened by an inner peripheral surface 25*c* of the tubular portion 25 (i.e., an inner peripheral surface 26*c* of the first semi-tubular portion 26 and an inner peripheral surface 27*c* of the second semi-tubular portion 27). The rubber bushing 23 is designed such that an elastic property thereof has anisotropy. Therefore, if an insertion position of the rubber bushing 23 in the tubular portion 25 is not fixed, the elastic property of the rubber bushing 23 varies. To realize the designed elastic property of the rubber bushing 23, the rubber bushing 23 needs to be positioned with respect to the tubular portion 25.

In the present embodiment, by providing a positioning pin 29 at the first semi-tubular portion 26, the rubber bushing 23 is positioned with respect to the tubular portion 25. The positioning pin 29 is fixed to a pin hole 26*d* formed at the inner peripheral surface 26*c* of the first semi-tubular portion 26.

A concave portion 23*d* that is concave inward in the radial direction is formed at an outer peripheral surface 23*c* of the cylindrical portion 23*a* of the rubber bushing 23. A portion of the positioning pin 29 which portion projects from the pin hole 26*d* engages with the concave portion 23*d* of the rubber bushing 23. With this, the rubber bushing 23 is non-rotatable about a center O of the tubular portion 25. Thus, the rubber bushing 23 is positioned with respect to the tubular portion 25.

The following will explain steps of producing the axle box suspension 16 configured as above.

Figure 5A:
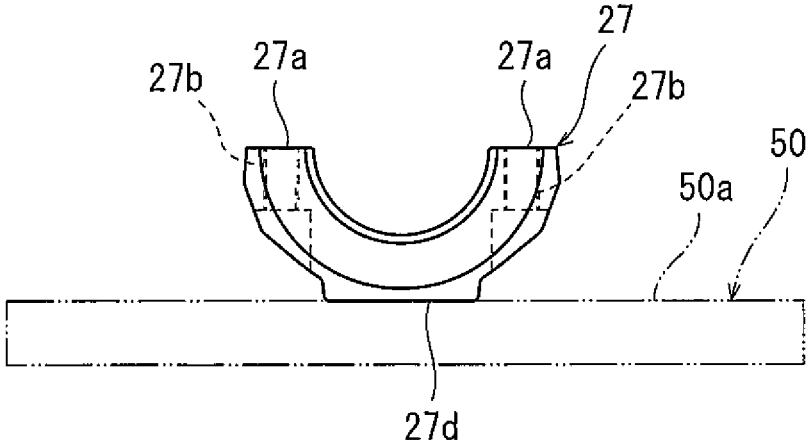
FIGS. 5A to 5C are diagrams for explaining a procedure of forming the tubular portion of the axle beam in a method of producing the axle box suspension shown in FIG. 2.
Figure 5B:
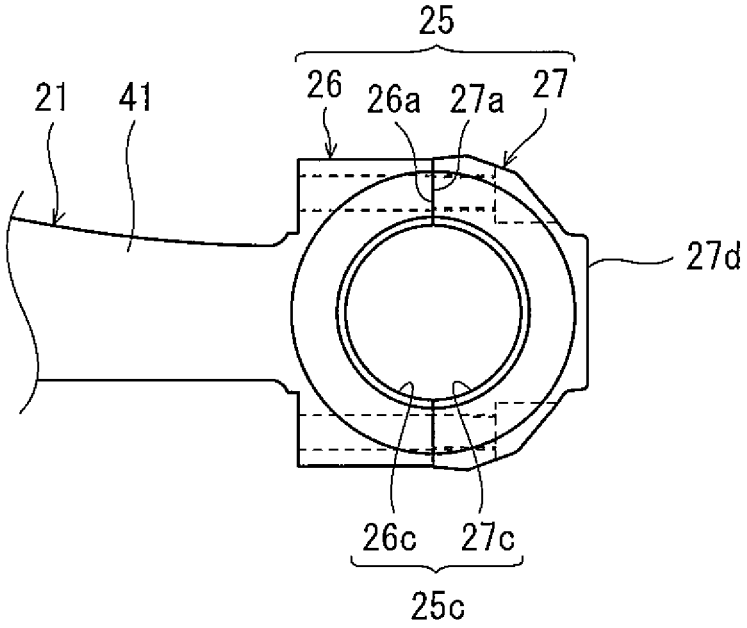
Figure 5C:
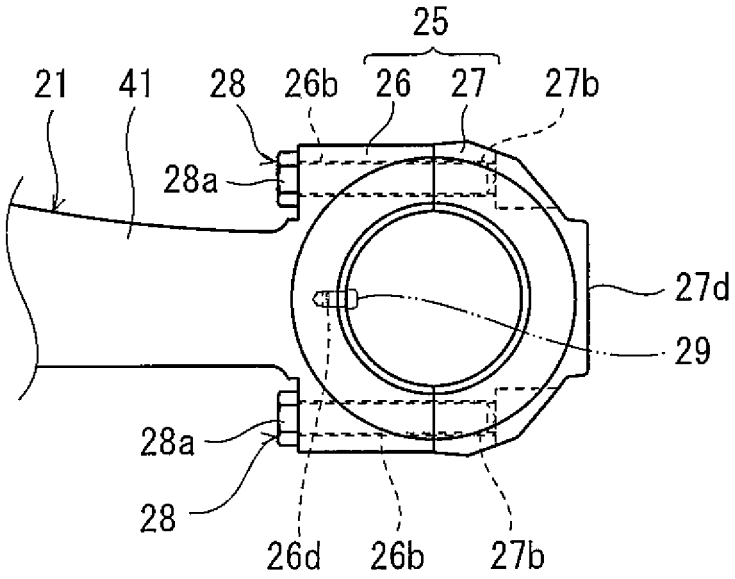

FIGS. 5A to 5C are diagrams for explaining a procedure of forming the tubular portion 25 of the axle beam 21 in a method of producing the axle box suspension 16 shown in FIG. 2. First, a preform molded by casting or forging is prepared as a preform of the second semi-tubular portion 27. Then, as shown in FIG. 5A, the preform of the second semi-tubular portion 27 is provided at a machining device 50 with the machining reference surface 27*d* placed on a surface plate 50*a* of the machining device 50. The machining device 50 is, for example, a machining center which has an automatic tool changing function and therefore performs plural types of machining work alone. With the second semi-tubular portion 27 provided at the machining device 50, an opposing surface machining step of flattening the opposing surface 27*a* and a threaded hole forming step of forming the threaded holes 27*b* are performed. Therefore, the posture of the second semi-tubular portion 27 provided at the machining device 50 in the threaded hole forming step is the same as that in the opposing surface machining step.

Next, the first semi-tubular portion 26 formed integrally with the axle beam main body portion 41 is prepared, and an opposing surface machining step of flattening the opposing surface 26*a* and a drilled hole forming step of forming the drilled holes 26*b* are performed (not shown).

Subsequently, as shown in FIG. 5B, the opposing surface 27*a* of the second semi-tubular portion 27 after the machining in FIG. 5A and the opposing surface 26*a* of the first semi-tubular portion 26 are brought into surface contact with each other. At this time, the first semi-tubular portion 26 and the second semi-tubular portion 27 are fixed to each other by a temporary bolt (not shown).

With the first semi-tubular portion 26 and the second semi-tubular portion 27 contacting each other and fixed to each other, an inner peripheral surface machining step is performed with respect to the tubular portion 25. Specifically, complete circle machining is performed such that the inner peripheral surface 25*c* of the tubular portion 25 has a completely circular shape when viewed from the car width direction. With this, the rubber bushing 23 inserted into the tubular portion 25 is satisfactorily tightened by the inner peripheral surface 25*c* subjected to the complete circle machining.

After the inner peripheral surface machining step is terminated, only the first semi-tubular portion 26 is left at the machining device, and a pin hole forming step of forming the pin hole 26*d*, into which the positioning pin 29 is inserted, at the inner peripheral surface 26*c* is performed. To be specific, in the pin hole forming step, only the inner peripheral surface 26*c* of the first semi-tubular portion 26 is machined, and the inner peripheral surface 27*c* of the second semi-tubular portion 27 is not machined. It should be noted that the pin hole forming step may be performed in the opposing surface machining step performed for the first semi-tubular portion 26. After the pin hole forming step performed for the first semi-tubular portion 26 is terminated, machining performed for the tubular portion 25 is completed.

Next, the rubber bushing 23 is brought into contact with the inner peripheral surface 26*c* of the first semi-tubular portion 26, and the concave portion 23*d* of the rubber bushing 23 engages with the positioning pin 29 provided at the first semi-tubular portion 26. Then, the rubber bushing 23 is brought into contact with the inner peripheral surface 27*c* of the second semi-tubular portion 27, and the rubber bushing 23 is sandwiched by the first semi-tubular portion 26 and the second semi-tubular portion 27.

Last, the opposing surfaces 26*a* and 27*a* of the first and second semi-tubular portions 26 and 27 are brought into contact with each other and fixed to each other by the bolts 28. Thus, the axle box suspension 16 is formed.

Hereinafter, a method of producing a conventional axle box suspension will be explained for comparison with the producing method of the present embodiment.

Figure 6A:
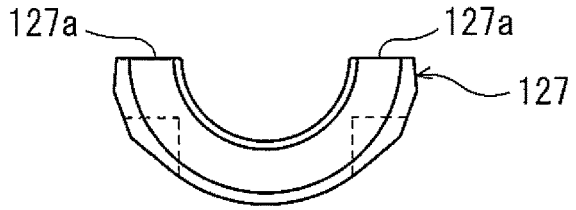
FIGS. 6A to 6E are diagrams for explaining a procedure of forming a tubular portion of an axle beam in a method of producing a conventional axle box suspension.
Figure 6B:
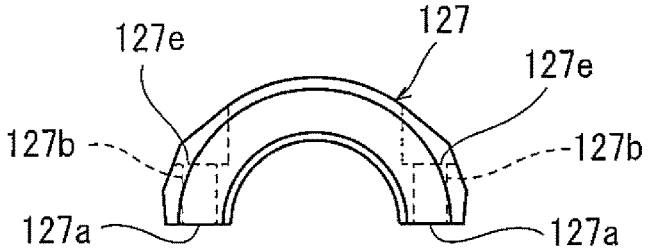
Figure 6C:
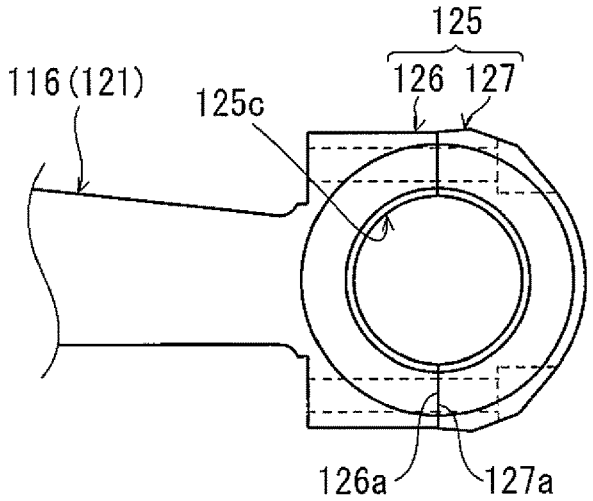
Figure 6D:
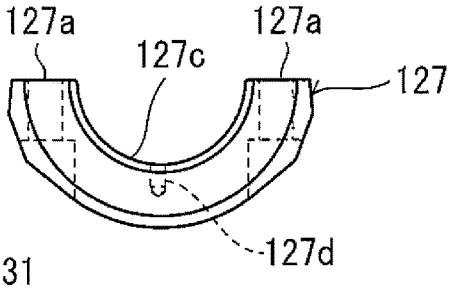
Figure 6E:
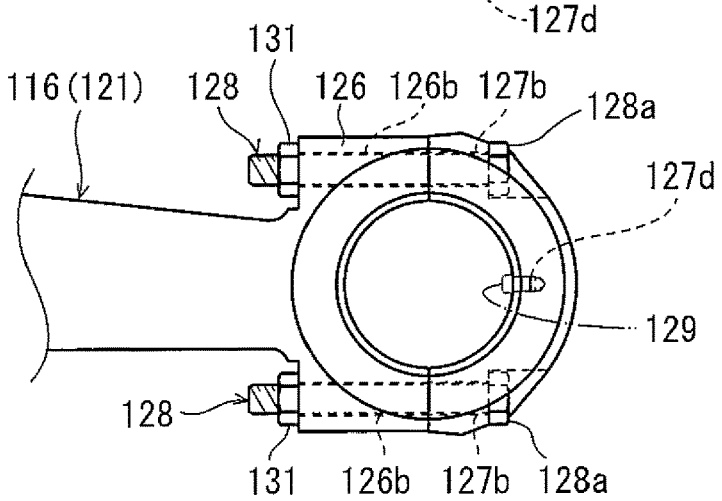

FIGS. 6A to 6E are diagrams for explaining a procedure of forming the tubular portion 125 of an axle beam 121 in the method of producing a conventional axle box suspension 116. Hereinafter, differences of the conventional tubular portion 125 from the tubular portion 25 according to the present embodiment will be explained. FIG. 6A shows a preform molded by casting or forging as a preform of the second semi-tubular portion 127. An outer shape of the second semi-tubular portion 127 is a semicircular shape, and only a circular-arc surface is formed at an opposite side of an opposing surface 127*a* of the second semi-tubular portion 127. Therefore, unlike the present embodiment, a flat machining reference surface is not formed at the second semi-tubular portion 127. On this account, when flattening the opposing surface 127*a*, the second semi-tubular portion 127 needs to be supported by a separate structure so as to be stably provided at the machining device.

Next, as shown in FIG. 6B, the second semi-tubular portion 127 is reversed and then provided on the machining device such that the flattened opposing surface 127*a* faces downward. Then, a drilled hole forming step of forming holes 127*b* into which the bolts 128 are inserted and a counterboring step of forming seat surfaces 127*e* contacting respective head portions 128*a* of the bolts 128 are performed.

As above, to form the drilled holes 127*b* with a high degree of accuracy and to flatten the seat surfaces 127*e* with a high degree of accuracy, the second semi-tubular portion 127 needs to be reversed.

Next, as shown in FIG. 6C, the first semi-tubular portion 126 and the second semi-tubular portion 127 are provided on the machining device with the first semi-tubular portion 126 and the second semi-tubular portion 127 contacting each other, and an inner peripheral surface 125*c* of the tubular portion 125 is subjected to complete circle machining. After the first semi-tubular portion 126 and the second semi-tubular portion 127 are subjected to the complete circle machining, only the second semi-tubular portion 127 is provided at the machining device, and a pin hole 127*d* is formed at an inner peripheral surface 127*c*.

Last, the first semi-tubular portion 127 and the second semi-tubular portion 127 formed as above are brought into contact with each other and are fixed to each other by the bolts 128 and nuts 131.

When producing the conventional axle box suspension 116 as above, required as steps of the machining with respect to the second semi-tubular portion 127 are the counterboring step and the pin hole forming step in addition to the opposing surface machining step and the drilled hole forming step. Further, since set-up change work needs to be performed many times, man-hours increase.

The axle box suspension 16 of the railcar the bogie 1 configured as above has the following effects.

Since the second semi-tubular portion 27 includes the machining reference surface 27*d*, the second semi-tubular portion 27 can be stably placed on the surface plate 50*a* of the machining device 50, and the opposing surface machining step and the threaded hole machining step can be performed with a high degree of accuracy. When performing these two steps, set-up change work of reversing the posture of the second semi-tubular portion 27 is unnecessary. Therefore, the working property improves.

Further, the holes 27*b* of the second semi-tubular portion 27 are subjected to tapping. Therefore, when fixing the first semi-tubular portion 26 and the second semi-tubular portion 27, nuts are unnecessary, and counterboring is also unnecessary.

Further, the positioning pin 29 of the rubber bushing 23 is attached to the first semi-tubular portion 26. With this, work man-hours required for the machining with respect to the second semi-tubular portion 27 can be made smaller than the conventional configuration in which the pin is attached to the second semi-tubular portion 127.

Embodiment 2

Figure 7:
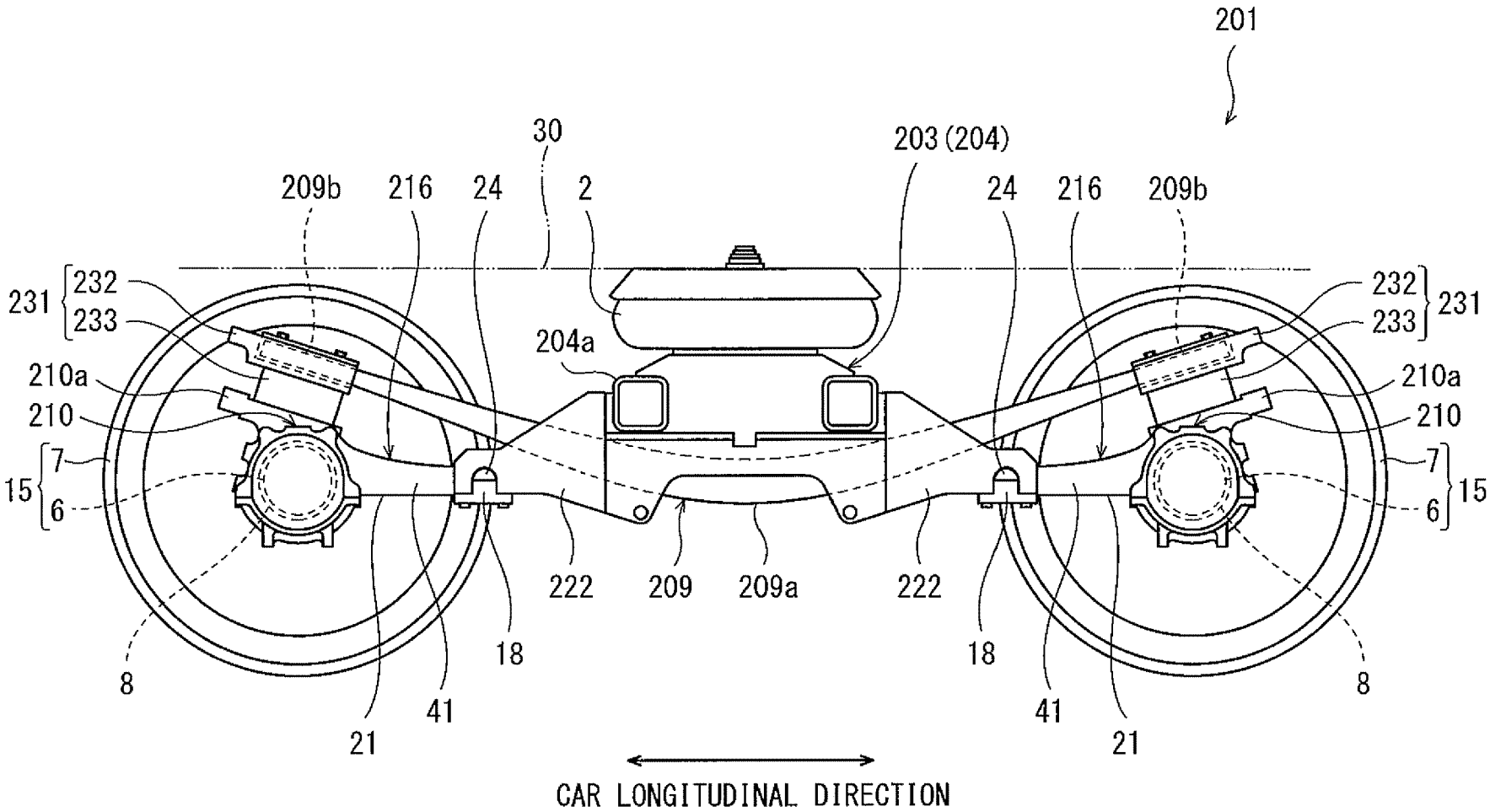
FIG. 7 is a side view of the railcar bogie according to Embodiment 2.

FIG. 7 is a side view of a bogie 201 according to Embodiment 2. The bogie 201 of Embodiment 2 is obtained by partially modifying, for example, the configuration of the bogie frame 3 of the bogie 1 according to Embodiment 1. Hereinafter, differences of the bogie 201 according to Embodiment 2 from the bogie 1 according to Embodiment 1 will be explained.

As shown in FIG. 7, a bogie frame 203 includes a cross beam 204 extending in the car width direction at a car longitudinal direction middle of the bogie 201. However, unlike the configuration of the bogie frame 3 of Embodiment 1, the bogie frame 203 does not include side sills extending in the car longitudinal direction from both respective car width direction end portions 204*a* of the cross beam 204. A pair of the receiving seats 222 constituting an axle box suspension 216 are provided at the car width direction end portion 204*a* of the cross beam 204 so as to project outward in the car longitudinal direction. The core rod 24 of the tubular portion 25 of the axle beam 21 is sandwiched by the receiving seats 222 and the lid member 18.

Each of plate springs 209 extends between an axle box 210 and the cross beam 204 in the car longitudinal direction. Car longitudinal direction middle portions 209*a* of the plate springs 209 support both respective car width direction end portions 204*a* of the cross beam 204 from below, and both car longitudinal direction end portions 209*b* of each of the plate springs 209 are supported by the respective axle boxes 210. To be specific, the plate spring 209 has both the function of the axle spring 20 (primary suspension) of Embodiment 1 and the function of the side sill 5 of Embodiment 1.

The car longitudinal direction end portion 209*b* of the plate spring 209 is supported by the axle box 210 from below through a supporting member 231. The supporting member 231 is provided at an upper portion of the axle box 210. The supporting member 231 includes a receiving member 232 and a vibrationproof rubber 233. The receiving member 232 has a substantially rectangular shape in a plan view. The receiving member 232 includes: a bottom wall portion supporting a lower surface of the plate spring 209; and outer wall portions projecting upward from both respective car longitudinal direction ends of the bottom wall portion. An upper surface of the supporting member 231 is inclined obliquely downward toward a middle side in the car longitudinal direction. It should be noted that the upper surface of the supporting member 231 does not have to be inclined as long as the upper surface of the supporting member 231 is substantially parallel to a lower surface of the car longitudinal direction end portion 209*b* of the plate spring 209.

The vibrationproof rubber 233 is substantially columnar and is inserted between the axle box 210 and the receiving member 232. The axle box 210 includes a spring seat 210*a* having an upper surface that is in surface contact with a lower surface of the vibrationproof rubber 233. The upper surface of the spring seat 210*a* is also substantially parallel to the lower surface of the plate spring 209 and is inclined obliquely downward toward the middle side in the car longitudinal direction. Other than the above configuration, Embodiment 2 is the same as Embodiment 1.

Embodiment 2 configured as above has the same effects as Embodiment 1. To be specific, the axle box suspension 216 including the second semi-tubular portion 27 having the flat machining reference surface 27*d* as with Embodiment 1 is applicable to not only the bogie 1 including the typical bogie frame 3 but also the bogie 201 including the plate spring 209.

The present invention is not limited to the above embodiments, and modifications, additions, and eliminations may be made within the scope of the present invention. The above embodiments may be combined arbitrarily. For example, some of components or methods in one embodiment may be applied to another embodiment. Further, some of components in the embodiment may be separated and extracted arbitrarily from the other components in the embodiment. In the above embodiment, the tubular portion 25 is divided in the car longitudinal direction. However, the tubular portion 25 may be divided in the upward/downward direction. Further, a plurality of positioning pins 29 may be attached to the tubular portion 25. To be specific, a plurality of pin holes 26*d* may be formed at arbitrary positions on the inner peripheral surface 26*c* of the first semi-tubular portion 26 based on a virtual line VL.

REFERENCE SIGNS LIST

1, 201 railcar bogie
6 axle
8 bearing
10 axle box
16, 216 axle box suspension
21 axle beam
22, 222 receiving seat
23 rubber bushing (elastic bushing)
23*c* outer peripheral surface
23*d* concave portion
24 core rod
25 tubular portion
25*c* inner peripheral surface
26 first semi-tubular portion
26*a* opposing surface
26*b* drilled hole (hole)
26*c* inner peripheral surface
27 second semi-tubular portion
27*a* opposing surface
27*b* threaded hole (hole)
27*d* machining reference surface
28 bolt
29 positioning pin
41 axle beam main body portion
42 axle beam end portion
50 machining device
50*a* surface plate
S internal space

The invention claimed is:

1. An axle box suspension of a railcar bogie,
the axle box suspension comprising:
an axle beam including
an axle beam main body portion extending in a car longitudinal direction from an axle box accommodating a bearing supporting an axle and
an axle beam end portion provided at a tip end of the axle beam main body portion, a tubular portion at the axle beam end portion and open at both car width direction sides;
a core rod inserted into an internal space of the tubular portion in a car width direction;
an elastic bushing interposed between the tubular portion and the core rod; and a receiving seat provided at a bogie frame, both end portions of the core rod being connected to the receiving seat, the tubular portion including a first semi-tubular portion integral with the axle beam main body portion, a second semi-tubular portion which is brought into contact with the first semi-tubular portion from one side in the car longitudinal direction, and a bolt by which the second semi-tubular portion is fastened to the first semi-tubular portion in the car longitudinal direction, the first semi-tubular portion including a first opposing surface that is flat and in surface contact with the second semi-tubular portion and a first hole extending perpendicular to the first opposing surface, the bolt being inserted into the first hole, the second semi-tubular portion including a second opposing surface that is flat and in surface contact with the first opposing surface, a flat machining reference surface at an opposite side of the second opposing surface and configured to stably support the second semi-tubular portion on a surface plate of a machining device, wherein the flat machining reference surface is a surface of a protrusion extending out of a generally convex side of the second semi tubular portion, and a second hole extending perpendicular to the second opposing surface, the bolt being inserted into the second hole.

2. The axle box suspension according to claim 1, wherein:

the first hole of the first semi-tubular portion is a drilled hole;

the second hole of the second semi-tubular portion is a threaded hole; and the bolt is inserted from the first semi-tubular portion toward the second semi-tubular portion.

3. The axle box suspension according to claim 1, further comprising a positioning pin attached to the tubular portion and engaging with the elastic bushing, wherein:

a concave portion with which the pin engages is at an outer peripheral surface of the elastic bushing; and the pin is attached to an inner peripheral surface of the first semi-tubular portion.

4. A method of producing an axle box suspension of a railcar bogie, the axle box suspension including an axle beam, the axle beam including an axle beam main body portion extending in a car longitudinal direction from an axle box accommodating a bearing supporting an axle and an axle beam end portion provided at a tip end of the axle beam main body portion, a tubular portion being formed at the axle beam end portion and being open at both car width direction sides, the tubular portion including a first semi-tubular portion formed integrally with the axle beam main body portion, a second semi-tubular portion which is brought into contact with the first semi-tubular portion, and a bolt by which the second semi-tubular portion is fastened to the first semi-tubular portion, the method comprising:

an opposing surface machining step of providing the second semi-tubular portion at a machining device such that a flat machining reference surface of the second semi-tubular portion contacts a surface plate of the machining device, and flattening a flat opposing surface of the second semi-tubular portion, the opposing surface being formed to be in surface contact with the first semi-tubular portion, the machining reference surface being formed at an opposite side of the opposing surface;

a hole forming step of forming a hole at the second semi-tubular portion which is in a same posture as in the opposing surface machining step, the bolt being inserted into the hole; and an inner peripheral surface machining step of subjecting an inner peripheral surface of the tubular portion to complete circle machining with the second semi-tubular portion staked on the first semi-tubular portion.

5. The method according to claim 4, wherein:

the hole forming step is a threaded hole forming step of forming a threaded hole into which the bolt is inserted; and the bolt is inserted from the first semi-tubular portion toward the second semi-tubular portion.

* * * * *